US008433380B1

(12) United States Patent
Kim et al.

(10) Patent No.: US 8,433,380 B1
(45) Date of Patent: Apr. 30, 2013

(54) MÖSSBAUER SPECTROSCOPY SYSTEM FOR APPLYING EXTERNAL MAGNETIC FIELD AT CRYOGENIC TEMPERATURE USING REFRIGERATOR

(75) Inventors: Chul-Sung Kim, Seoul (KR); Bong-Yeon Won, Kyunggi-Do (KR)

(73) Assignee: Kookmin University Industry Academic Cooperation Foundation (KR)

( * ) Notice: Subject to any disclaimer, the term of this patent is extended or adjusted under 35 U.S.C. 154(b) by 0 days.

(21) Appl. No.: 13/338,871

(22) Filed: Dec. 28, 2011

(51) Int. Cl.
*H01F 39/00* (2006.01)

(52) U.S. Cl.
USPC ..... 505/163

(58) Field of Classification Search ..... 505/163, 505/892, 897
See application file for complete search history.

(56) References Cited

U.S. PATENT DOCUMENTS 3,894,403 A * 7/1975 Longsworth ..... 62/51.1
5,327,733 A * 7/1994 Boolchand et al. ..... 62/51.1

* cited by examiner

*Primary Examiner* — Colleen Dunn
(74) *Attorney, Agent, or Firm* — The Farrell Law Firm, P.C.

(57) ABSTRACT

A Mössbauer spectroscopy system for applying an external magnetic field at cryogenic temperature using a refrigerator is provided. A Mössbauer spectrum can be obtained by applying the external magnetic field while changing the temperature of a superconducting magnet and a sample from a cryogenic temperature using the refrigerator, the external magnetic field can be applied while cooling the superconducting magnet using the refrigerator without the need for use of a liquid helium, thereby saving the operation cost according to consumption of the liquid helium, the mounting of a sample which it is desired to measure is easy, thereby minimizing a possibility that a worker will be exposed to gamma rays, and a convenience in use of a user can be improved.

5 Claims, 3 Drawing Sheets

MÖSSBAUER SPECTROSCOPY SYSTEM FOR APPLYING EXTERNAL MAGNETIC FIELD AT CRYOGENIC TEMPERATURE USING REFRIGERATOR

BACKGROUND OF THE INVENTION

1. Field of the Invention

Exemplary embodiment of the present invention relates to a Mössbauer spectroscopy system for applying an external magnetic field at cryogenic temperature using a refrigerator, in which a Mössbauer spectrum can be obtained by applying the external magnetic field while changing the temperature of a superconducting magnet and a sample from a cryogenic temperature using the refrigerator, in which the external magnetic field can be applied while cooling the superconducting magnet using the refrigerator without the need for use of a liquid helium, thereby saving the operation cost according to consumption of the liquid helium, in which the mounting of a sample which it is desired to measure is easy, thereby minimizing a possibility that a worker will be exposed to gamma rays, and in which a convenience in use of a user can be improved.

2. Background of the Related Art

Conventionally, a Mössbauer spectrometer which applies an external magnetic field cools a superconducting magnet using a liquid helium to obtain the external magnetic field. Such a Mössbauer spectrometer entails a problem in that it is difficult to install peripheral devices, i.e., a transducer for obtaining a spectrum and a detector, and much time is spent to cool the superconducting magnet during the operation thereof, and a large amount of liquid helium is required to measure a sample for a long period of time, leading to a great increase in cost.

In addition, the Mössbauer spectrometer, which is a device which performs a phase analysis using $^{57}Co$ as a radiation source, involves a drawback in that the long-term exposure to the radiation source can result in severe injury to the human body.

Thus, it is very important that a manipulator of the Mössbauer spectrometer conducts the analysis after completing the loading of a sample as quickly as possible.

There is therefore an urgent need for the development of a Mössbauer spectroscopy system for applying an external magnetic field at cryogenic temperature using a refrigerator, which can apply the external magnetic field while cooling a superconducting magnet using the refrigerator without the need for use of a liquid helium, thereby saving the operation cost according to consumption of the liquid helium, can make it easy to mount a sample which it is desired to measure, thereby minimizing a possibility that a worker will be exposed to gamma rays, can improve a convenience in use of a user.

SUMMARY OF THE INVENTION

Accordingly, the present invention has been made in order to solve the above-mentioned problems occurring in the prior art, and it is an object of the present invention to provide a Mössbauer spectroscopy system for applying an external magnetic field at cryogenic temperature using a refrigerator, in which a Mössbauer spectrum can be obtained by applying the external magnetic field while changing the temperature of a superconducting magnet and a sample from a cryogenic temperature using the refrigerator.

Another object of the present invention is to provide a Mössbauer spectroscopy system for applying an external magnetic field at cryogenic temperature using a refrigerator, in which the external magnetic field can be applied while cooling the superconducting magnet using the refrigerator without the need for use of a liquid helium, thereby saving the operation cost according to consumption of the liquid helium.

Still another object of the present invention is to provide a Mössbauer spectroscopy system for applying an external magnetic field at cryogenic temperature using a refrigerator, in which the mounting of a sample which it is desired to measure is easy, thereby minimizing a possibility that a worker will be exposed to gamma rays.

Yet another object of the present invention is to provide a Mössbauer spectroscopy system for applying an external magnetic field at cryogenic temperature using a refrigerator, in which a convenience in use of a user can be improved.

To achieve the above object, in accordance with an embodiment, the present invention provides a Mössbauer spectroscopy system for applying an external magnetic field at cryogenic temperature using a refrigerator, the system including a Mössbauer driving unit configured to be supplied with electric power from a power supply section to generate a periodic signal; a Mössbauer velocity transducer configured to receive the periodic signal from the Mössbauer driving unit, the Mössbauer velocity transducer having a function in which when a sawtooth wave is formed at a start point where the Mössbauer velocity transducer receives the periodic signal from the Mössbauer driving unit, the sawtooth wave is converted to a parabolic wave by an integration circuit and then is amplified to be made large to obtain a strong current signal, and a function in which when the amplified signal is applied to a driving coil of the Mössbauer velocity transducer, a copper shaft positioned at the center of the driving coil periodically performs a uniformly accelerated motion by a magnetic field vertically acting on the driving oil but complete uniform acceleration does not occur, and thus the non-uniform motion is offset by negatively feedbacking an electrical signal induced to an induction coil arranged on the cooper shaft to be opposite to the driving coil; a gamma ray source attached to one end of the copper shaft within the Mössbauer velocity transducer and configured to emit gamma rays; a sample (i.e., absorber) configured to absorb the gamma rays emitted from the gamma ray source; a superconducting magnet configured to generate a magnetic field for application to the sample; a refrigerator configured to cool the temperature of the sample to the cryogenic temperature; a proportional counter (i.e., detector) configured to count electrical signals transmitted through the sample by resonant absorption; an amplifier configured to amplify the electrical signals outputted from the proportional counter; a data acquisition module configured to receive the amplified signals from the amplifier and store data of the proportional counter by channels through a Mössbauer program; and a computer configured to display data including the changes in the temperature and magnetic field stored in the data acquisition module in the form of a spectrum through a Mössbauer data analysis program.

In accordance with an embodiment of the present invention, when the proportional counter is applied with direct current (DC) high voltage (1000 to 2000V) from a high voltage power supply, gamma rays may be incident in a counter tube to ionize gas inside the counter tube, and the number of ions may be proportional to energy of photons of the gamma rays, and thus the counting of the photons of the gamma rays incident in the counter tube may include the counting of pulse.

In accordance with an embodiment of the present invention, the amplifier may include both a low noise preamplifier and a main preamplifier.

In accordance with an embodiment of the present invention, the superconducting magnet may use an NbTi superconducting wire, and may be configured to apply a magnetic field of up to 50 KG (Kilo Gauss) to the sample. Also, a superconducting material of more than 70 K may be used as a high-temperature superconducting wire which blocks infiltration of an external heat into the superconducting magnet and supplies current used to allow high current to flow therein without any generation of heat.

In accordance with an embodiment of the present invention, the temperature of the sample may be cooled to the cryogenic temperature by the refrigerator, and then may be controlled in the ranging from 4.2 K to 325 K by a heater and a temperature controller, which are mounted on a sample tube and a sample holder.

BRIEF DESCRIPTION OF THE DRAWINGS

The above and other objects, features and advantages of the present invention will be apparent from the following detailed description of the preferred embodiments of the invention in conjunction with the accompanying drawings, in which.

EXPLANATION OF SYMBOLS

Figure 1:
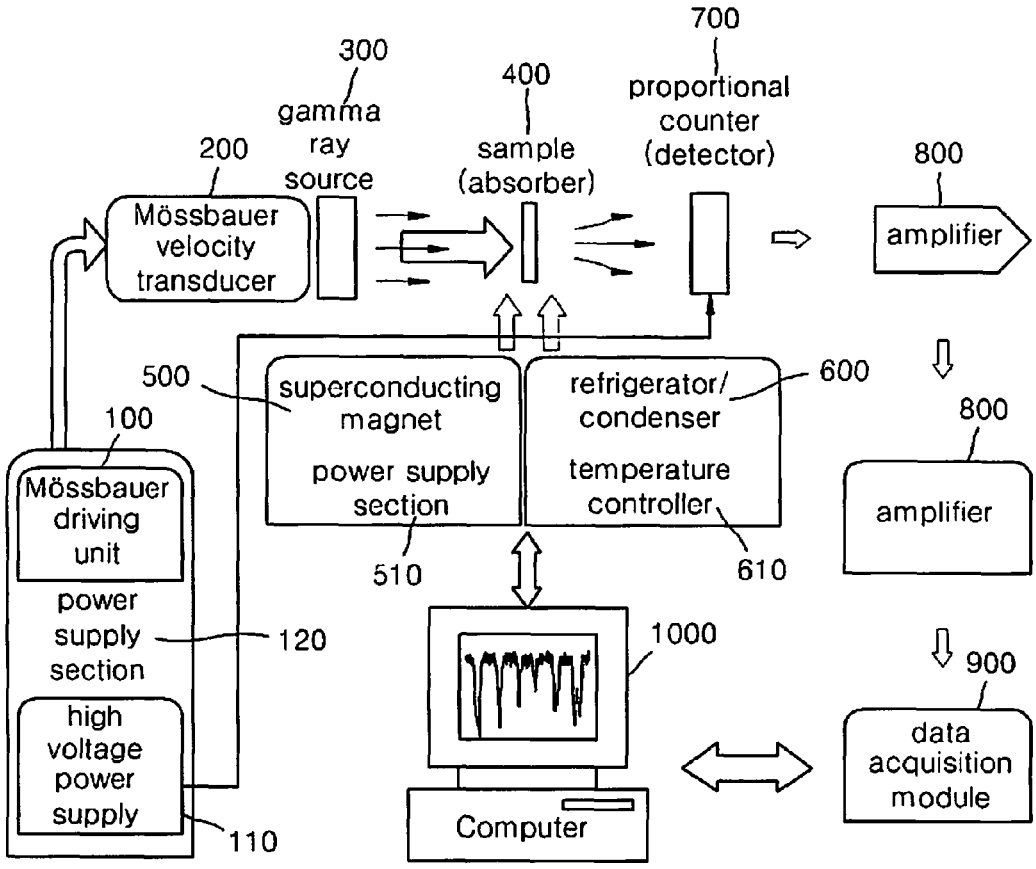
FIG. 1 is a block diagram illustrating the construction of a Mössbauer spectroscopy system for applying an external magnetic field at cryogenic temperature using a refrigerator in accordance with an embodiment of the present invention.

100: Mössbauer driving unit
200: Mössbauer velocity transducer
300: gamma ray source
400: sample (absorber)
500, 21: superconducting magnet
600: refrigerator/condenser
700: proportional counter (detector)
800: amplifier
900: data acquisition module
1000: computer
110: high voltage power supply
120, 510: power supply section
610: temperature controller

DETAILED DESCRIPTION OF THE PREFERRED EMBODIMENTS

Reference will be now made in detail to preferred embodiments of the present invention with reference to the attached drawings. In the following description, the detailed description on known function and constructions unnecessarily obscuring the subject matter of the present invention will be avoided hereinafter. Also, the terms used herein are defined in consideration of the function of the present invention, which may vary according to an intention of a user or an operator or according to custom. Thus, definition of such terms should be made based on content throughout the specification disclosing a Mössbauer spectroscopy system for applying an external magnetic field at cryogenic temperature using a refrigerator in accordance with an embodiment of the present invention.

Now, a Mössbauer spectroscopy system for applying an external magnetic field at cryogenic temperature using a refrigerator in accordance with a preferred embodiment of the present invention will be described hereinafter in more detail with reference to the accompanying drawings.

Figure 2:
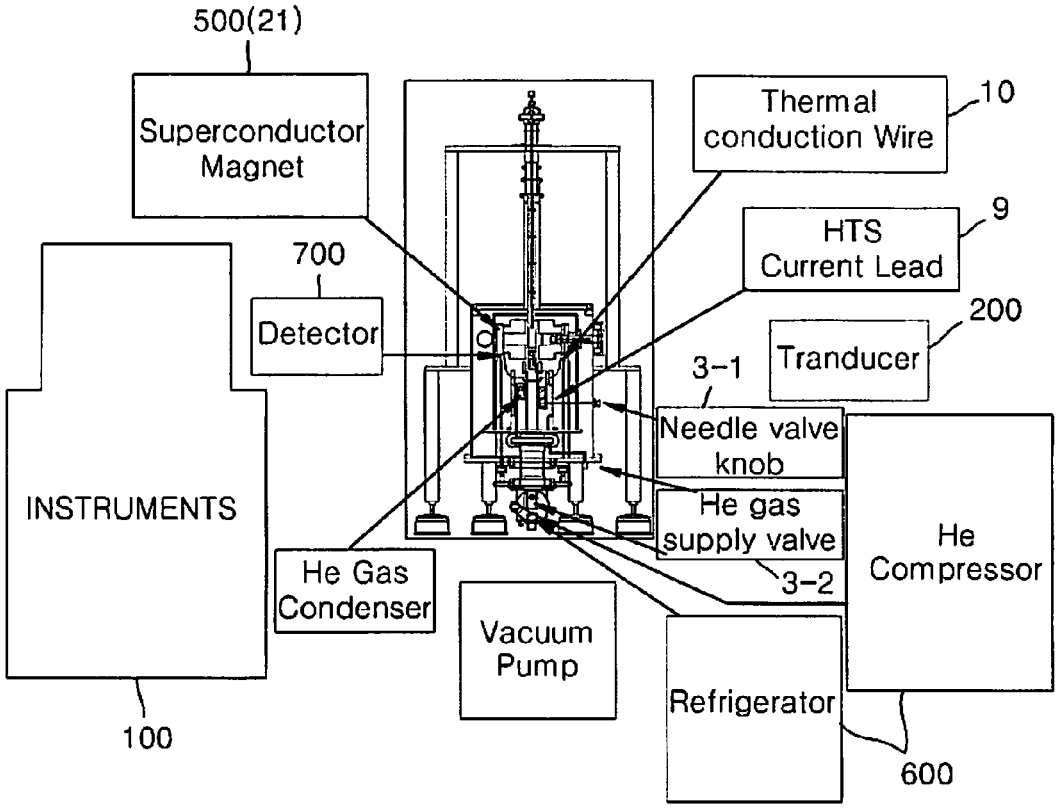
FIG. 2 is a photographic diagram illustrating the main construction for measurement of a Mössbauer spectroscopy system for applying an external magnetic field at cryogenic temperature using a refrigerator in accordance with an embodiment of the present invention, in which a sample is mounted and a magnetic field is applied at cryogenic temperature.
Figure 3:
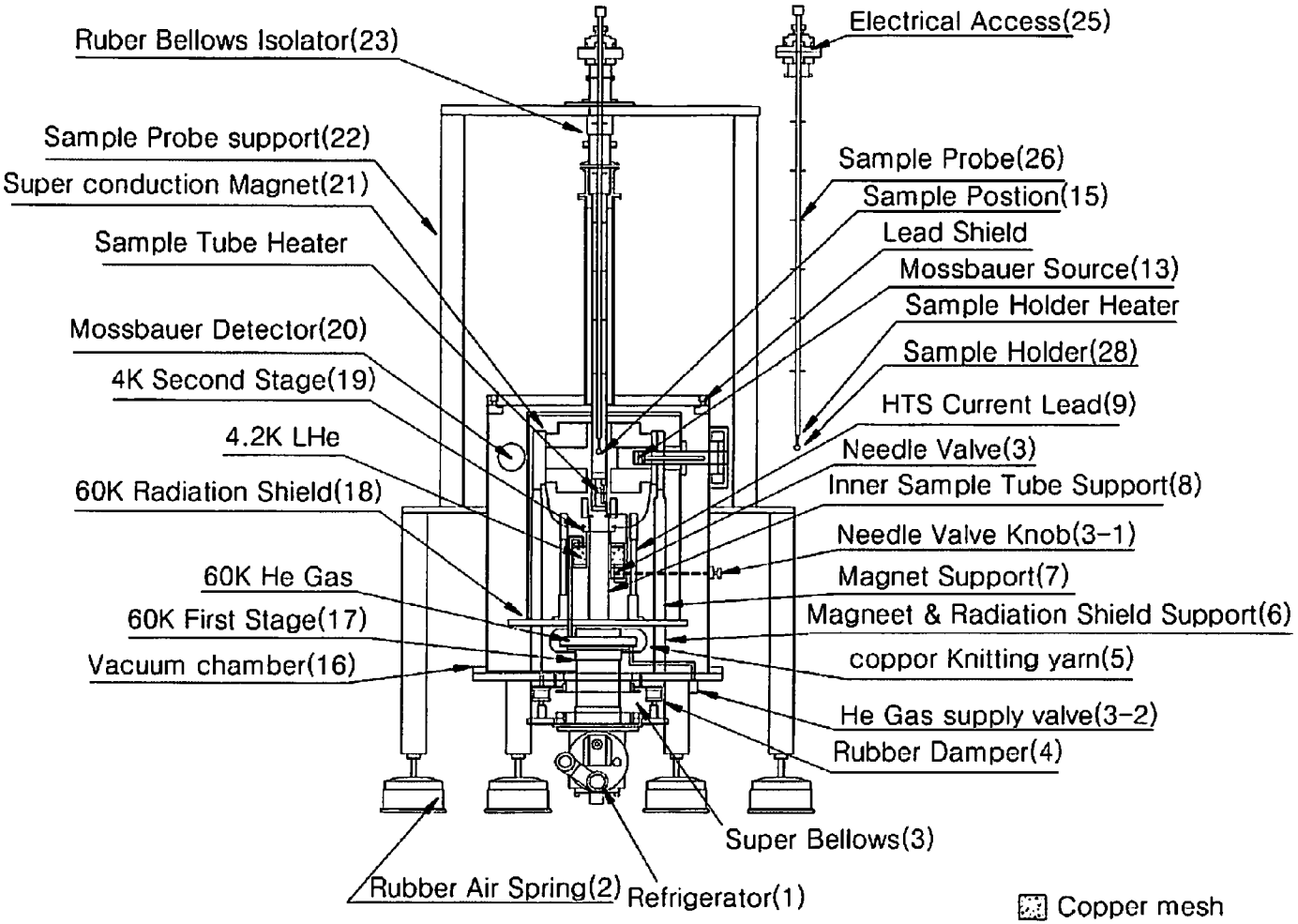
FIG. 3 is a schematic diagram illustrating the detailed construction for measurement of a Mössbauer spectroscopy system for applying an external magnetic field at cryogenic temperature using a refrigerator in accordance with an embodiment of the present invention, in which a sample is mounted and a magnetic field is applied at cryogenic temperature.

FIG. 1 is a block diagram illustrating the construction of a Mössbauer spectroscopy system for applying an external magnetic field at cryogenic temperature using a refrigerator in accordance with an embodiment of the present invention, FIG. 2 is a photographic diagram illustrating the main construction for measurement of a Mössbauer spectroscopy system for applying an external magnetic field at cryogenic temperature using a refrigerator in accordance with an embodiment of the present invention, in which a sample is mounted and a magnetic field is applied at cryogenic temperature, and FIG. 3 is a schematic diagram illustrating the detailed construction for measurement of a Mössbauer spectroscopy system for applying an external magnetic field at cryogenic temperature using a refrigerator in accordance with an embodiment of the present invention, in which a sample is mounted and a magnetic field is applied at cryogenic temperature.

A Mössbauer spectroscopy is a characteristic analysis technique using a micro phenomenon occurring in a high resolution energy level of $10^{-12}$ eV satisfying Heisenberg's uncertainty principle and in a time interval in the range of $10^{-7}$ second.

In addition, a Mössbauer spectrometer quantum-mechanically analyzes tiny changes in specific energy levels using a gamma-ray resonance according to the Doppler effect through spectra, so that hyperfine field, isomer shift, super-exchange interaction, quadruple splitting, electric field gradient distribution, determination of Curie temperature, determination of Debye temperature by changes in resonant absorption line area, determination of spinwave constant, superparamagnetic limit, etc., can be grasped.

As shown in FIGS. 1 to 3, the Mössbauer spectroscopy system for applying an external magnetic field at cryogenic temperature using a refrigerator according to the present invention includes: a Mössbauer driving unit 100 configured to be supplied with electric power from a power supply section to generate a periodic signal; a Mössbauer velocity transducer 200 configured to receive the periodic signal from the Mössbauer driving unit, the Mössbauer velocity transducer having a function in which when a sawtooth wave is formed at a start point where the Mössbauer velocity transducer receives the periodic signal from the Mössbauer driving unit, the sawtooth wave is converted to a parabolic wave by an integration circuit and then is amplified to be made large to obtain a strong current signal, and a function in which when the amplified signal is applied to a driving coil of the Mössbauer velocity transducer, a copper shaft positioned at the center of the driving coil periodically performs a uniformly accelerated motion by a magnetic field vertically acting on the driving oil but complete uniform acceleration does not occur, and thus the non-uniform motion is offset by negatively feedbacking an electrical signal induced to an induction coil arranged on the cooper shaft to be opposite to the driving coil; a gamma ray source 300 attached to one end of the copper shaft within the Mössbauer velocity transducer and configured to emit gamma rays; a sample (i.e., absorber) 400 configured to absorb the gamma rays emitted from the gamma ray source; a superconducting magnet 500 configured to generate a magnetic field for application to the sample; a refrigerator 600 configured to cool the temperature of the sample to the cryogenic temperature; a proportional counter (i.e., detector) 700 configured to count electrical signals transmitted through the sample by resonant absorption; an amplifier 800 configured to amplify the electrical signals outputted from the proportional counter; a data acquisition module 900 configured to receive the amplified signals from the amplifier and store data of the proportional counter by channels through a Mössbauer program; and a computer 1000 configured to display data including the changes in the temperature and magnetic field stored in the data acquisition module in the form of a spectrum through a Mössbauer data analysis program.

The construction and function of the technical means constituting the Mössbauer spectroscopy system for applying an external magnetic field at cryogenic temperature using a refrigerator according to the present invention will be described hereinafter.

The Mössbauer driving unit 100 serves to be supplied with electric power from a power supply section 120 to generate a periodic signal.

The Mössbauer velocity transducer 200 serves to receive the periodic signal from the Mössbauer driving unit 100. Also, the Mössbauer velocity transducer 200 has a function in which when a sawtooth wave is formed at a start point where the Mössbauer velocity transducer receives the periodic signal from the Mössbauer driving unit, the sawtooth wave is converted to a parabolic wave by an integration circuit and then is amplified to be made large to obtain a strong current signal, and a function in which when the amplified signal is applied to a driving coil of the Mössbauer velocity transducer, a copper shaft positioned at the center of the driving coil periodically performs a uniformly accelerated motion by a magnetic field vertically acting on the driving oil but complete uniform acceleration does not occur, and thus the non-uniform motion is offset by negatively feedbacking an electrical signal induced to an induction coil arranged on the cooper shaft to be opposite to the driving coil.

The gamma ray source 300 is attached to one end of the copper shaft within the Mössbauer velocity transducer to generate gamma rays.

The sample (i.e., absorber) 400 serves to absorb the gamma rays emitted from the gamma ray source.

The superconducting magnet 500 serves to generate a magnetic field for application to the sample. The superconducting magnet 500 is supplied with electric power from a power supply section 510. Herein, the superconducting magnet 500 uses an NbTi superconducting wire, and can apply the magnetic field of up to 50 KG (Kilo Gauss) to the sample. In addition, a superconducting material of more than 70 K is used as a high-temperature superconducting wire which blocks infiltration of an external heat into the superconducting magnet 500 and supplies current used to allow high current to flow therein without any generation of heat.

The refrigerator 600 functions to cool the temperature of the sample to the cryogenic temperature. The temperature of the sample is cooled to the cryogenic temperature by the refrigerator, and then is controlled in the ranging from 4.2 K to 325 K by a heater and a temperature controller 610, which are mounted on a sample tube and a sample holder. A heater 12 and a needle valve 3 are used to control the temperature of the sample in the range from 4 K to 300 K while maintaining the temperature of the superconducting magnet 1 at below 6 K. When helium gas is supplied to the refrigerator under constant pressure (<5 Psig) through a helium (He) gas supply valve 3-2, it is cooled to 60 K in a first stage of the refrigerator and then the helium gas cooled to 60 K is introduced into a second stage of the refrigerator in which the cooled helium gas is in turn condensed into liquid helium (LHe, 4.2 K). Then, the condensed liquid helium lowers the temperature (4.2 K) of a sample tube 14 by turning a needle valve knob 3-1 to adjust the amount of liquid helium supplied toward a sample holder 28. The temperature of the sample can be controlled in the range from 4.2 K to 325 K using the heater 12 and the needle valve knob 3-1 attached to the sample holder 28 and the sample tube 14.

The proportional counter (i.e., detector) 700 serves to count electrical signals transmitted through the sample by resonant absorption. Herein, when the proportional counter 700 is applied with direct current (DC) high voltage (1000-2000V) from a high voltage power supply 110, gamma rays are incident in a counter tube to ionize gas inside the counter tube. In this case, the number of ions is proportional to energy of photons of the gamma rays, and thus the counting of the photons of the gamma rays incident in the counter tube includes the counting of pulse.

The amplifier 800 functions to amplify the electrical signals (pulse current) outputted from the proportional counter. The amplifier 800 includes both a low noise preamplifier and a main preamplifier.

The data acquisition module 900 acts to receive the amplified signals from the amplifier and store data of the proportional counter by channels through a Mössbauer program.

The computer 1000 serves to display data including the changes in the temperature and magnetic field stored in the data acquisition module in the form of a spectrum through a Mössbauer data analysis program.

Through the detailed construction for measurement of a Mössbauer spectroscopy system for applying an external magnetic field at cryogenic temperature using a refrigerator, in which a sample is mounted and a magnetic field is applied at cryogenic temperature as shown in FIGS. 2 and 3, the function and correlation of the technical means constituting the Mössbauer spectroscopy system will be discussed hereinafter in more detail.

As shown in FIGS. 2 and 3, there is shown a construction of the Mössbauer spectroscopy system in which a superconducting magnet 21 is allowed to apply an external magnetic field of up to 50 KG to a sample placed at a sample position 15 using a refrigerator 1 but not a liquid helium, and the temperature of the sample can be controlled in the rage from 4 K to 300 K. The sample is attached to the sample holder 28, and then a sample probe 26 is mounted through a sample entrance 24. In addition, when the inside of a vacuum chamber 16 is maintained in a vacuum state and the refrigerator 1 is operated, the first stage 17 and the temperature of the second stage 19 of the refrigerator begins to be lowered. The heat transfer is performed through a cooper knitting yarn 5 connected to the first stage 17 of the refrigerator such that the temperature of a radiation shield 18 is lowered to below 60 K, and a copper knitting yarn 10 connected to the second stage 19 is allowed to apply an external magnetic field while maintaining the temperature of a superconducting magnet 21 below 6 K.

The refrigerator 1 is a cooler that lowers the temperature by circulating helium gas in a closed loop, and has a cooling power of 1.5 W at 4.2 K. The refrigerator is driven mechanically to generate vibration. A rubber air spring 2, a super bellows 3, a copper knitting yarn 5, a thermal conduction wire 10, a rubber damper 4, and a rubber bellows 23 are used to prevent the vibration from being transmitted to the sample holder 28, the vacuum chamber 16, the radiation shield 18, the superconducting magnet 21, and the sample tube 14.

A high-temperature superconducting wire 9 uses a superconducting material of more than 70 K as a wire which blocks infiltration of an external heat into the superconducting magnet 500 and supplies current used to allow high current to flow therein without any generation of heat. An NbTi superconducting wire is used to form a superconducting magnet at below 9.8 K. When data is acquired for a long period of time by attaching a persistent switch, an external magnetic field can be applied to the sample without supply of power from the outside. A quench protection diode is mounted as a protective device.

The superconducting magnet 21 is mounted inside the vacuum chamber 16 and the radiation shield 18 using a G10 support 6. The superconducting magnet 21 is maintained at below 6 K due to heat transfer by a copper knitting yarn coated with silver and an oxygen-free copper plate coated with gold so as to restrict the vibration from the second stage 19 of the refrigerator from being transmitted to the superconducting magnet 21.

The vacuum chamber 16 is maintained in a vacuum state at the inside thereof where the superconducting magnet 21, the first stage 17 and the second stage 19 of the refrigerator, and the radiation shield 18 are mounted so as to block introduction of heat from the outside thereof.

The radiation shield 18 is lowered to below 60 K while blocking vibration from the refrigerator through the silver-coated copper knitting yarn 5 connected to the first stage 17 of the refrigerator so as to prevent infiltration of external radiation heat (300 K) having an effect on a portion positioned at the inside of the radiation shield 18, i.e., a portion cooled to 4 K (second stage 19) and the superconducting magnet 21.

The rubber bellows 23 are used to prevent micro vibration from the vacuum chamber 16 from being transmitted to the sample.

The heater 12 mounted on the sample tube 14 and the heater mounted on the sample holder 28 control the temperature of the sample in the range from 4 K to 300 K in a very precise manner (below +1-0.01 K).

The sample probe 26 allows the sample to be positioned in the middle of the superconducting magnet 21 and the sample to be placed at the optimum position adjacent to Mössbauer detector 20 and the Mössbauer source. The temperature measurement and control of the sample can be made through a 10-pin connector 25.

In addition, the heater 12 and the needle valve 3 are used to control the temperature of the sample in the range from 4 K to 300 K while maintaining the temperature of the superconducting magnet 21 at below 6 K. When helium gas is supplied to the refrigerator under constant pressure (<5 Psig) through the helium (He) gas supply valve 3-2, it is cooled to 60 K in the first stage of the refrigerator and then the helium gas cooled to 60 K is introduced into the second stage of the refrigerator in which the cooled helium gas is in turn condensed into liquid helium (LHe, 4.2 K). Then, the condensed liquid helium lowers the temperature (4.2 K) of the sample tube 14 by turning the needle valve knob 3-1 to adjust the amount of liquid helium supplied toward the sample holder 28. The temperature of the sample can be controlled in the range from 4.2 K to 325 K using the heater 12 and the needle valve knob 3-1 attached to the sample holder 28 and the sample tube 14.

The Mössbauer spectroscopy system for applying an external magnetic field at cryogenic temperature using a refrigerator in accordance with the exemplary embodiments of the present invention has the following advantageous effects.

First, a Mössbauer spectrum can be obtained by applying the external magnetic field while changing the temperature of a superconducting magnet and a sample from a cryogenic temperature using a refrigerator.

Second, the external magnetic field can be applied while cooling the superconducting magnet using the refrigerator without the need for use of liquid helium, thereby saving the operation cost according to consumption of the liquid helium.

Third, the mounting of a sample to be measured is easy, thereby minimizing a possibility that a worker will be exposed to gamma rays.

Fourth, a convenience in use of a user can be improved.

While the present invention has been described in connection with the exemplary embodiments illustrated in the drawings, they are merely illustrative embodiments, and the invention is not limited to these embodiments. It is to be understood that various equivalent modifications and variations of the embodiments can be made by a person having an ordinary skill in the art without departing from the spirit and scope of the present invention. Therefore, various embodiments of the present invention are merely for reference in defining the scope of the invention, and the true technical scope of the present invention should be defined by the technical spirit of the appended claims.

What is claimed is:

1. A Mössbauer spectroscopy system for applying magnetic field at cryogenic temperature using refrigerator, comprising:

a Mössbauer driving unit configured to be supplied with electric power from a power supply section to generate a periodic signal;

a Mössbauer velocity transducer configured to receive the periodic signal from the Mössbauer driving unit, the Mössbauer velocity transducer having a function in which when a sawtooth wave is formed at a start point where the Mössbauer velocity transducer receives the periodic signal from the Mössbauer driving unit, the sawtooth wave is converted to a parabolic wave by an integration circuit and then is amplified to be made large to obtain a strong current signal, and a function in which when the amplified signal is applied to a driving coil of the Mössbauer velocity transducer, a copper shaft positioned at the center of the driving coil periodically performs a uniformly accelerated motion by a magnetic field vertically acting on the driving oil but complete uniform acceleration does not occur, and thus the non-uniform motion is offset by negatively feedbacking an electrical signal induced to an induction coil arranged on the cooper shaft to be opposite to the driving coil;

a gamma ray source attached to one end of the copper shaft within the Mössbauer velocity transducer and configured to emit gamma rays;

a sample (i.e., absorber) configured to absorb the gamma rays emitted from the gamma ray source;

a superconducting magnet configured to generate a magnetic field for application to the sample;

a refrigerator configured to cool the temperature of the sample to the cryogenic temperature;

a proportional counter (i.e., detector) configured to count electrical signals transmitted through the sample by resonant absorption;

an amplifier configured to amplify the electrical signals outputted from the proportional counter;

a data acquisition module configured to receive the amplified signals from the amplifier and store data of the proportional counter by channels through a Mössbauer program; and a computer configured to display data including the changes in the temperature and magnetic field stored in the data acquisition module in the form of a spectrum through a Mössbauer data analysis program.

2. The Mössbauer spectroscopy system according to claim 1, wherein when the proportional counter is applied with Direct Current (DC) high voltage (1000 to 2000V) from a high voltage power supply, gamma rays are incident in a counter tube to ionize gas inside the counter tube, and wherein the number of ions is proportional to energy of photons of the gamma rays, and thus the counting of the photons of the gamma rays incident in the counter tube includes the counting of pulse.

3. The Mössbauer spectroscopy system according to claim 1, wherein the amplifier comprises both a low noise preamplifier and a main preamplifier.

4. The Mössbauer spectroscopy system according to claim 1, wherein the superconducting magnet uses an NbTi superconducting wire, and is configured to apply a magnetic field of up to 50 Kilo Gauss (KG) to the sample, and wherein a superconducting material of more than 70 K is used as a high-temperature superconducting wire which blocks infiltration of an external heat into the superconducting magnet and supplies current used to allow high current to flow therein without any generation of heat.

5. The Mössbauer spectroscopy system according to claim 1, wherein the temperature of the sample is cooled to the cryogenic temperature by the refrigerator, and then is controlled in the ranging from 4.2 K to 325 K by a heater and a temperature controller, which are mounted on a sample tube and a sample holder.

* * * * *